US005378287A

United States Patent [19]

Pedziwiatr

[11] Patent Number: 5,378,287

[45] Date of Patent: Jan. 3, 1995

[54] COMPACT ULTRASONIC CLEANING AND DRYING MACHINE AND METHOD

[75] Inventor: Edward A. Pedziwiatr, Cresskill, N.J.

[73] Assignee: Zenith Mfg. & Chemical Corporation, Closter, N.J.

[21] Appl. No.: 108,127

[22] Filed: Aug. 17, 1993

[51] Int. Cl.[6] ..... B08B 3/12

[52] U.S. Cl. ..... 134/1; 134/26; 134/61; 134/79

[58] Field of Search ..... 134/1, 26, 61, 79

[56] References Cited

U.S. PATENT DOCUMENTS

| | | | |
|---|---|---|---|
| 2,319,391 | 5/1943 | Davis | 134/94.1 |
| 2,673,835 | 3/1954 | Kearney | 134/79 |
| 3,002,731 | 10/1961 | Gelfand et al. | 134/1 |
| 3,096,774 | 7/1963 | Rand | 134/79 |
| 3,302,655 | 2/1967 | Sasaki et al. | 134/79 |
| 3,401,668 | 9/1968 | Welsh et al. | 118/70 |
| 3,606,896 | 9/1971 | Holm | 134/79 |
| 3,687,144 | 8/1972 | Borcoman et al. | 134/79 |
| 3,759,735 | 9/1973 | Pekosh | 427/64 |
| 3,861,409 | 1/1975 | Taniguchi | 134/43 |
| 4,062,437 | 12/1977 | Knapp | 134/66 |
| 4,409,999 | 10/1983 | Pedziwiatr | 134/95.2 |

*Primary Examiner*—Richard O. Dean
*Assistant Examiner*—Zeinab El-Arini
*Attorney, Agent, or Firm*—Samuelson & Jacob

[57] ABSTRACT

An ultrasonic cleaning and drying machine and method in which batches of articles to be cleaned and dried are indexed along a path of travel which follows a compact loop through an ultrasonic cleaning and rinsing station, where the articles are cleaned and rinsed at a first location for a first predetermined timed interval, and a drying station, where the articles are subjected to drying at further locations for a second predetermined timed interval which is a multiple of the first predetermined timed interval, the further locations being equal in number to the multiple such that each batch of articles is cleaned and rinsed at the first location, and then is dried at each further location to complete the cleaning and drying along the compact loop and deliver a batch of clean and dry articles at the expiration of each first predetermined timed interval.

11 Claims, 3 Drawing Sheets

FIG. 3
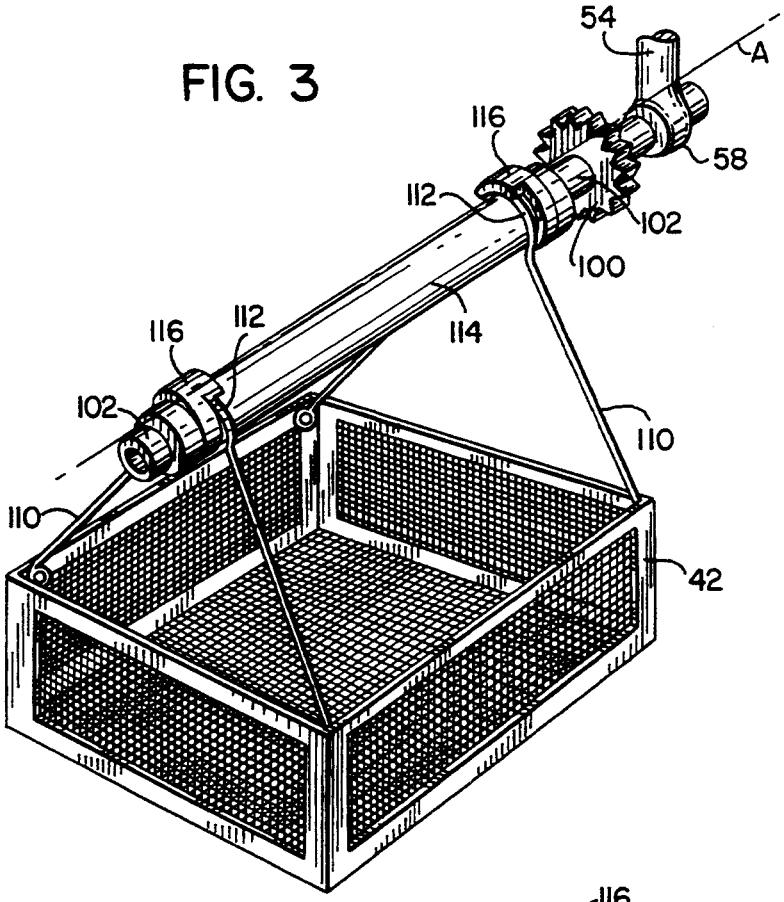
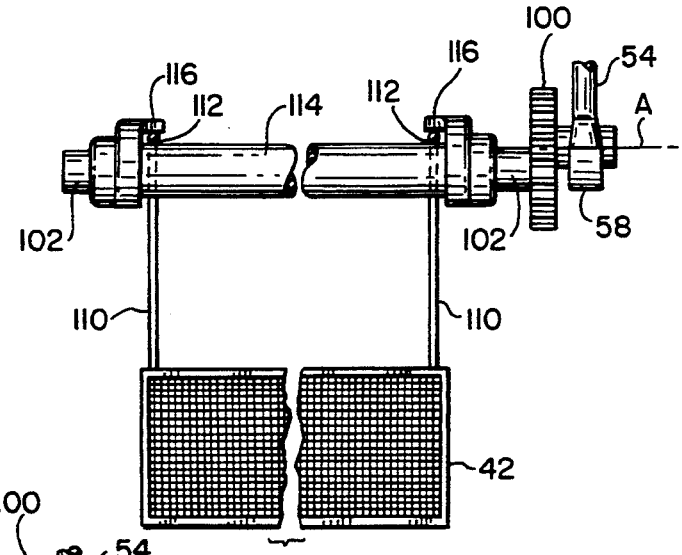
FIG. 4
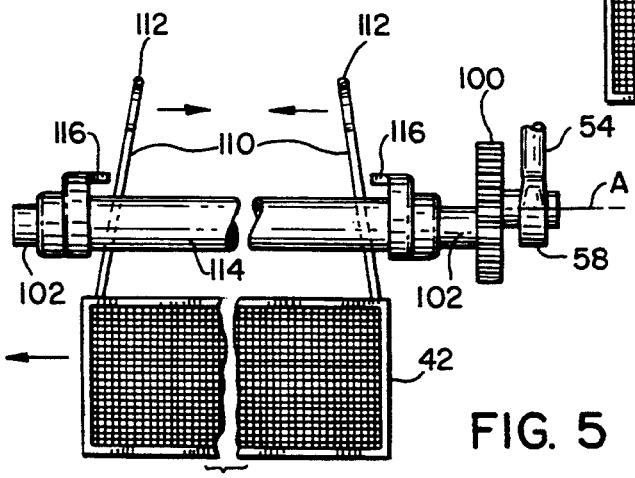
FIG. 5

COMPACT ULTRASONIC CLEANING AND DRYING MACHINE AND METHOD

The present invention relates generally to the ultrasonic cleaning of articles and pertains, more specifically, to a compact ultrasonic cleaning and drying apparatus and method by which articles are cleaned and dried on an essentially continuous production basis within a minimal amount of space.

With the increasing emphasis on environmental safety, the use of volatile solvents, such as chlorofluorocarbons, for cleaning and drying various articles is being discontinued, especially in industrial processes in which greases and other heavy oil-like substances must be cleaned from manufactured parts. Ultrasonic cleaning has been available as an alternative to the use of volatile solvents; however, whereas parts cleaned with volatile solvents are dried very quickly after cleaning, articles cleaned by ultrasonic techniques, which utilize aqueous solutions, usually are relatively wet and require a much longer drying cycle. Thus, while ultrasonic cleaning is capable of cleaning large numbers of articles quickly and effectively, ultrasonic cleaning and drying apparatus capable of cleaning and drying larger numbers of articles on a continuous production basis would require an inordinate amount of space dedicated to drying the articles subsequent to ultrasonic cleaning of the articles. As a result, ultrasonic cleaning heretofore has not supplanted cleaning with volatile solvents in larger scale industrial settings.

In my earlier patent, U.S. Pat. No. 4,409,999, there is described an automatic ultrasonic cleaning apparatus in which a single ultrasonic cleaning tank is employed for the ultrasonic cleaning, rinsing and drying of articles. The apparatus is compact, in that only one tank is required for the complete cleaning, rinsing and drying operation; however, the rapidity with which clean and dry articles are delivered is limited by the requirement for a relatively long drying time, in comparison to the relatively short cleaning and rinsing time.

The present invention overcomes the limitations imposed by the requirement for a relatively long drying time as compared to the shorter cleaning and rinsing time available in a compact ultrasonic cleaning machine, and attains several objects and advantages, some of which are summarized as follows: Provides for the effective ultrasonic cleaning, rinsing and drying of articles on an essentially continuous production basis with minimal space requirements; enables ultrasonic cleaning techniques to be utilized economically for cleaning articles heretofore processed with volatile solvents; promotes environmental safety by providing a commercially viable alternative to the use of volatile solvent cleaning techniques; provides a simplified apparatus and process for the ultrasonic cleaning and drying of articles to render the technique available for more widespread use; accomplishes effective ultrasonic cleaning at commercial production rates without the use of hazardous materials or the presence of hazardous conditions at the workplace; enables ease of operation for effective ultrasonic cleaning and drying in a wide variety of applications.

The above objects and advantages, as well as further objects and advantages, are attained by the present invention which may be described briefly as a relatively compact ultrasonic cleaning and drying machine in which articles to be cleaned are presented to a cleaning station where the articles are ultrasonically cleaned and rinsed, the ultrasonic cleaning and drying machine comprising: ultrasonic cleaning and rinsing means at the cleaning station for subjecting the articles to ultrasonic cleaning and rinsing over a first predetermined timed interval; drying means at a drying station closely juxtaposed with the cleaning station for subjecting the articles to drying over a second predetermined timed interval subsequent to the first predetermined timed interval; a loading station and an unloading station; and indexing means for advancing a plurality of the articles serially along a path of travel extending between the loading station and the unloading station, from one location to another location of a plurality of locations placed along the path of travel, the plurality of locations including a first location at the cleaning station and a number of further locations within the drying station; the second predetermined timed interval being a multiple of the first predetermined timed interval, and the number of further locations within the drying station being equal to that multiple such that each article is cleaned and rinsed at the first location, and then is subjected to drying at each further location along the path of travel between the loading station and the unloading station, the path of travel being a compact loop, whereby the ultrasonic cleaning and drying machine is rendered relatively compact and cleaned and dried articles are delivered at the unloading station upon the expiration of each first predetermined timed interval. Further, the invention includes a method for ultrasonically cleaning and drying articles, the method comprising: loading the articles at a loading station; subjecting the articles to ultrasonic cleaning and rinsing at a cleaning station over a first predetermined timed interval; subjecting the articles to drying at a drying station closely juxtaposed with the cleaning station over a second predetermined timed interval subsequent to the first predetermined timed interval; and advancing the articles serially along a path of travel extending from one location to another location of a plurality of locations placed along a path of travel extending from the loading station to an unloading station, the plurality of locations including a first location at the cleaning station and a number of further locations within the drying station; the second predetermined timed interval being a multiple of the first predetermined timed interval, and the number of further locations within the drying station being equal to that multiple such that each article is cleaned and rinsed at the first location, and then is subjected to drying at each further location along the path of travel between the loading station and the unloading station, the path of travel being a compact loop, whereby the method is accomplished in a relatively compact space and cleaned and dried articles are delivered at the unloading station upon the expiration of each first predetermined timed interval.

BRIEF DESCRIPTION OF THE DRAWINGS

The invention will be understood more fully, while still further objects and advantages will become apparent, in the following detailed description of preferred embodiments of the invention illustrated in the accompanying drawing, in which:

FIG. 3 is a fragmentary perspective view of an article carrier of the machine;

FIG. 4 is a side elevational view of the article carrier; and

FIG. 5 is a view similar to FIG. 4, but with the component parts shown in a different operating position.

Figure 1:
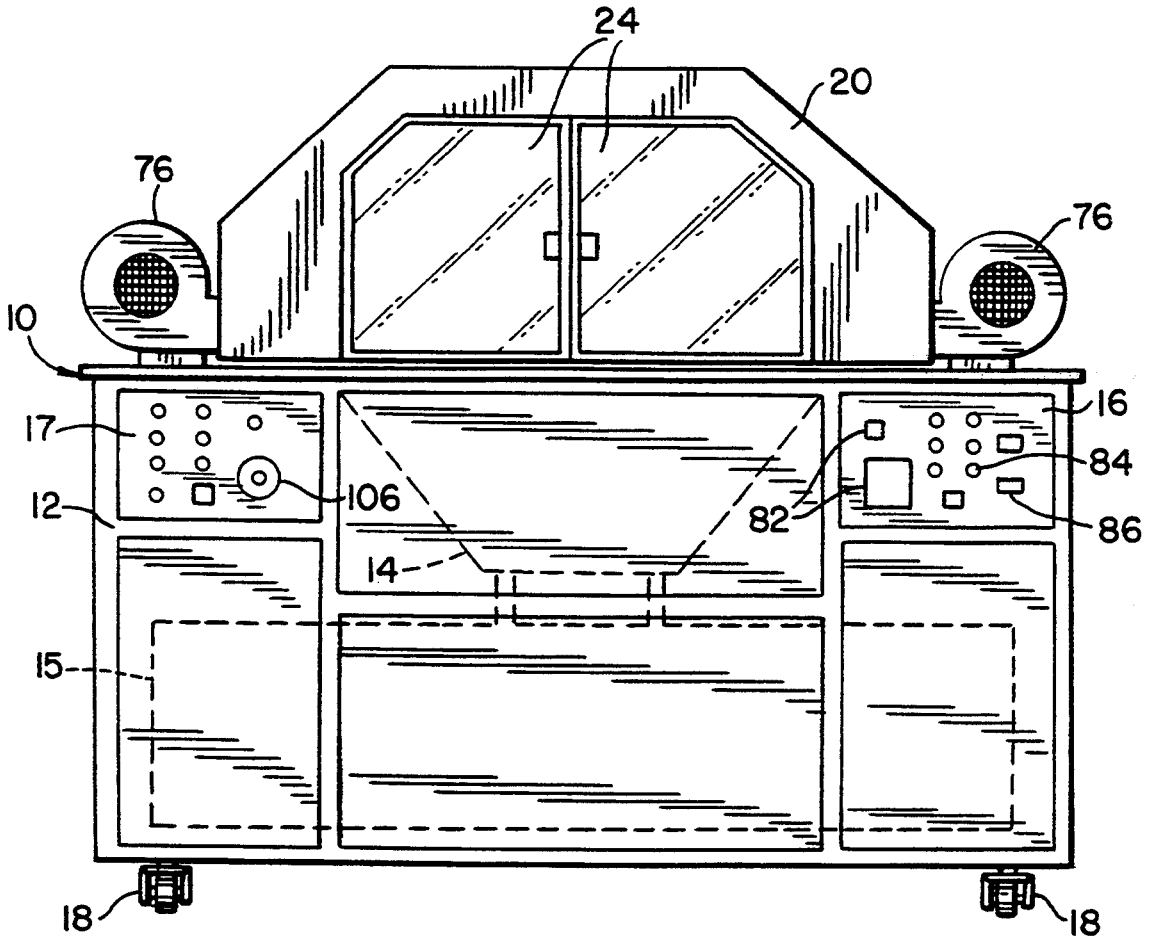
FIG. 1 is a front elevational view of a compact ultrasonic cleaning and drying machine constructed in accordance with the invention.

Referring now to the drawing, and especially to FIG. 1 thereof, a compact ultrasonic cleaning and drying machine constructed in accordance with the present invention is illustrated at 10 and is seen to include a console 12 within which are mounted various components of the machine 10, which components include a single cleaning and rinsing tank 14 and the several reservoirs, pumps and valves, represented schematically at 15, which, together with the tank 14, comprise an automatic ultrasonic cleaning and rinsing apparatus similar to that described in the above-cited U.S. Pat. No. 4,409,999, which patent is incorporated herein by reference thereto. Control panels 16 and 17 are located on the front of machine 10 and include the several controls for controlling the various functions of the machine 10, as will be explained in greater detail below. Frame 12 is supported on casters 18 which enable the machine 10 to be placed readily at any convenient location for use. An enclosure 20 closes in the top of the machine 10 and establishes a closed chamber 22 (see FIG. 2). A pair of access doors 24 which normally are closed, as shown, are selectively opened to gain access to the interior of the chamber 22 and internal working components of machine 10 for loading and unloading purposes, as will be explained below.

Figure 2:
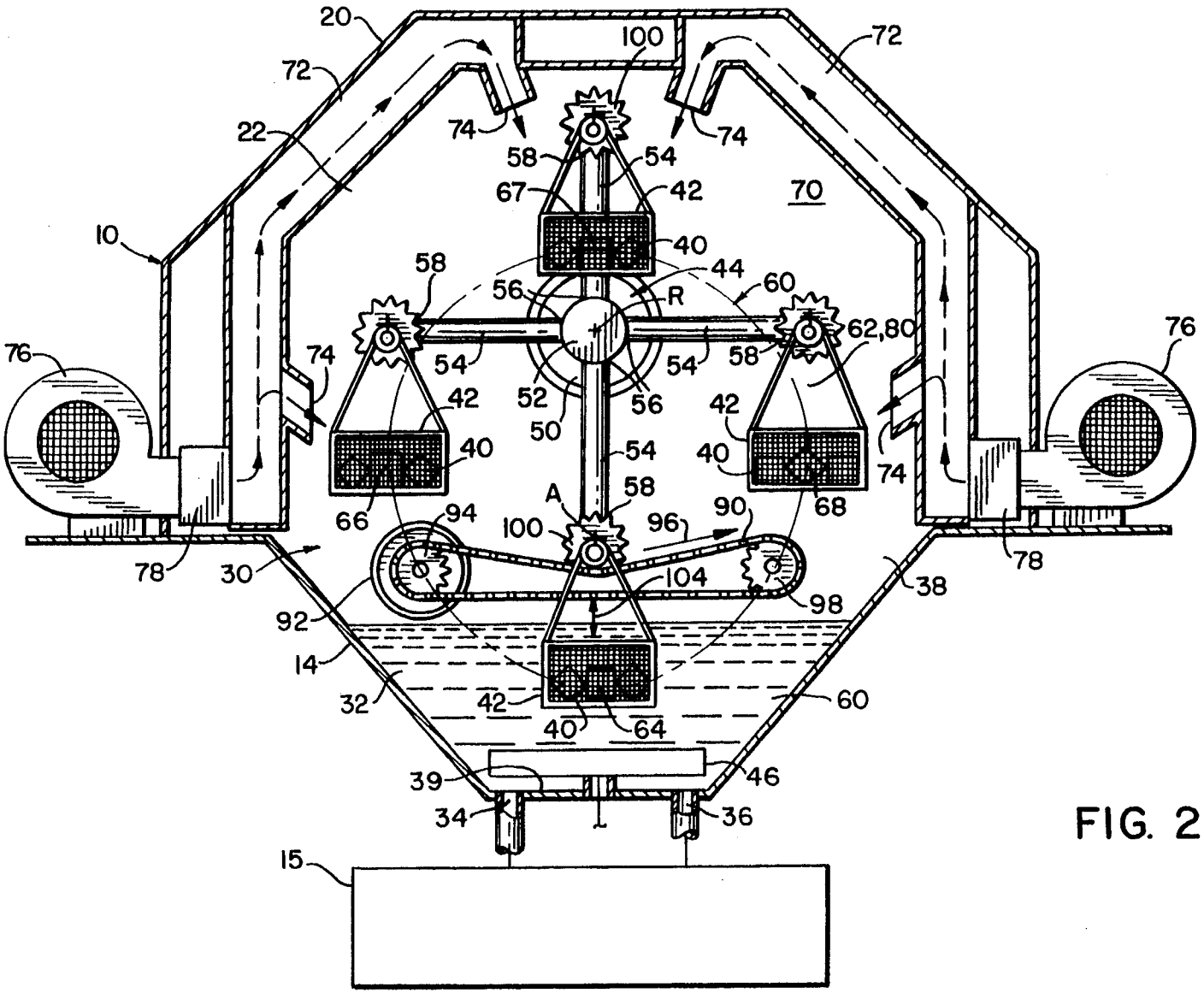
FIG. 2 is an enlarged diagrammatic view of the machine, illustrating the operation of the machine and the method of the invention.

Turning now to FIG. 2, machine 10 includes a cleaning station 30 wherein tank 14 is located. Tank 14 is seen to contain a bath 32 of liquid supplied to tank 14 through an inlet 34, and drained from tank 14 through an outlet 36, in essentially the manner described in the aforesaid U.S. Pat. No. 4,409,999. Thus, bath 32 is supplied with either an ultrasonic cleaning fluid or rinsing fluids, in accordance with a predetermined sequence of operations. Access to the bath 32 is available through an access opening 38 at the top of the tank 14, altitudinally opposite the bottom 39 of the tank 14. Articles to be cleaned are illustrated herein as parts 40 placed in batches within article carriers in the form of open mesh baskets 42 carried by indexing means illustrated generally at 44. As each basket 42 is immersed in bath 32, ultrasonic energy is transmitted to the bath 32 by means of ultrasonic energy inducer 46 immersed in the bath 32 and located near the bottom 39 of the tank 14 to accomplish ultrasonic cleaning and rinsing.

Indexing means 44 includes a drive motor 50 coupled to a central hub 52 and a plurality of arms 54 extending radially from a near end 56 at the hub 52, and affixed to the hub 52, to a far end 58, such that upon operation of drive motor 50, hub 52 and arms 54 are rotated about an axis of rotation R. Each basket 42 is suspended from the far end 58 of a corresponding arm 54, in a manner to be explained in greater detail below, so that the baskets 42 are moved along a path of travel 60 which extends through the cleaning station 30. Thus, each basket 42 is loaded onto the far end 58 of a corresponding arm 54 at a loading station 62 and then is advanced, in a generally clockwise direction, to a location 64 along the path of travel 60 wherein the basket 42 is immersed in the bath 32, along with the parts 40 in the basket 42. The immersed basket 42 at location 64 remains at that location 64 throughout a first predetermined timed interval during which complete ultrasonic cleaning and rinsing is accomplished, in a manner similar to that set forth in U.S. Pat. No. 4,409,999. Once the cycle of ultrasonic cleaning and rinsing is complete, the indexing means 44 rotates the hub 52 with the arms 54 to place the basket 42 of cleaned and rinsed parts 40 at a further location 66 along the path of travel 60. In the meantime, a subsequent basket 42, which has been loaded at loading station 62 onto the next subsequent arm 54, is advanced to location 64 to be immersed in the bath 32 for ultrasonic cleaning and rinsing. Thus, batches of articles 40 are advanced serially along path of travel 60.

Location 66 is the first of three locations 66, 67 and 68 placed along path of travel 60 within a drying station 70 located above the cleaning station 60, closely adjacent the access opening 38 at the top of the tank 14. Drying means at the drying station 70 include air ducts 72 within the enclosure 20, the air ducts 72 having air outlets 74 for directing heated air into the chamber 22 and toward the locations 66, 67 and 68 within the chamber 22 at drying station 70. Heated air is supplied to the ducts 72 by means of blowers 76 which draw in ambient air and direct the ambient air through heaters 78 and into ducts 72. In this manner, each basket 42 of parts 40 is subjected to heated air in the chamber 22 at each location 66, 67 and 68 so that each batch of parts 40 is subjected to drying for a second predetermined timed interval equal to the total time during which the corresponding basket 42 is located at the locations 66, 67 and 68. Upon expiration of the predetermined timed interval during which drying takes place, the basket 42 which is located at location 68 is unloaded, merely by reversing the loading procedure. Thus, location 68 is at an unloading station 80, which unloading station 80 is coincident with loading station 62.

In the above-described arrangement, the first predetermined timed interval, during which ultrasonic cleaning and rinsing is accomplished at cleaning station 30, is less than the second predetermined timed interval, during which drying is accomplished at the drying station 70, the second predetermined timed interval being a multiple of the first predetermined timed interval. Thus, as the baskets 42 are indexed from one location to another location, through all of the locations 64, 66, 67 and 68 along the path of travel 60, the total time spent by each basket 42 at locations 66, 67 and 68 in the drying station 70 is three times the time spent by that basket 42 at location 64 in the cleaning station 30. In a typical production operation, ultrasonic cleaning and rinsing is accomplished at the cleaning station 30 within about ten minutes, while drying requires about thirty minutes. Hence, each basket 42 is held at location 64 for ten minutes, to accomplish cleaning and rinsing, and subsequently is indexed so as to spend ten minutes at each location 66, 67 and 68, for a total of thirty minutes to complete drying.

Indexing is accomplished by intermittent operation of drive motor 50 in accordance with the timing dictated by the first and second prescribed timed intervals, which timing is selected by timer controls 82 on the control panel 16 of the machine 10. Further controls 84 and 86 on the control panel 16 of the machine 10 control the ultrasonic energy inducer 46 and the blowers 76. In this manner, a batch of clean and dry articles 40 is delivered at the unloading station 80 at the expiration of each first prescribed timed interval, which is the time required for ultrasonic cleaning and rinsing, while drying is accomplished over the requisite longer second prescribed timed interval.

In order to enhance cleaning and rinsing at the cleaning station 30, agitating means are provided in the form of an endless drive chain 90 driven by a further drive motor 92 coupled to a drive sprocket 94, so that upon operation of the drive motor 92, drive chain 90 is driven by drive sprocket 94 in the direction of the arrow 96 in FIG. 2, and moves around idler sprocket 98. As best seen in FIG. 3, as well as in FIG. 2, an agitation gear 100 is journaled for rotation at the far end 58 of each arm 54, about an axis of rotation A, and each basket 42 is suspended from a finger 102 which is affixed to a corresponding agitation gear 100 at a location which is eccentric to the axis of rotation A and which extends laterally from the far end 58 of the arm 54. When a basket 42 is placed at location 64, corresponding agitation gear 100 is engaged by the drive chain 100 and is rotated about axis A, thus causing the corresponding finger 102 to reciprocate upward and downward, as indicated by arrow 104 in FIG. 2, and thereby agitating the basket 42 within the bath 32 at location 64. The speed of drive motor 92, and, consequently, the intensity of the agitation, is controlled by a motor speed control 106 located on the control panel 17 of machine 10.

Referring now to FIGS. 3 through 5, each basket 42 is suspended from a corresponding finger 102 by means of bails 110, each bail 110 having a loop 112 which extends around a sleeve 114 freely journaled upon the finger 102. A clip 116 is juxtaposed with each loop 112 so that the bails 110 are held in place during agitation to assure that the agitation movements are transmitted to the basket 42 and the basket 42 remains in place securely on the sleeve 114. During unloading of a basket 42 at the unloading station 80, the bails 110 of a basket 42 manually are urged toward one another, as seen in FIG. 5, to release the loops 112 from beneath the clips 116 and enable the basket 42 to be raised and then moved laterally, in the direction of arrow 118 in FIG. 5, until the basket 42 is clear of the sleeve 114 and finger 102. Loading is accomplished merely by reversing the procedure to place the loops 112 of the bails 110 of a basket 42 beneath the clips 116 of a corresponding sleeve 114. Loading and unloading of baskets 42, each with a batch of articles 40 therein, is accomplished manually by opening at least one of the access doors 24 adjacent the loading, unloading station 62, 80 to gain access to the finger 102 at the loading, unloading station 62, 80, and reaching into the chamber 22 to remove a basket 42 of clean and dry articles 40 and to load another basket 42 of articles 40 to be cleaned and dried.

In the preferred arrangement of the indexing means, the axis of rotation R is oriented in a generally horizontal direction and the hub 52 and arms 54 are rotated about the horizontally oriented axis of rotation R so that the path of travel 60 lies in a generally vertical plane and follows a relatively compact closed loop juxtaposed with the tank 14, immediately adjacent to and above the tank 14. In this manner, the machine 10 is rendered relatively compact, requiring a minimum amount of floor space for placement at any convenient location. In this connection, it is noted that the machine 10 is completely self-contained and merely requires a source of electrical power at the operating location.

It will be seen that the present invention attains the several objects and advantages summarized above; namely: Provides for the effective ultrasonic cleaning, rinsing and drying of articles on an essentially continuous production basis with minimal space requirements; enables ultrasonic cleaning techniques to be utilized economically for cleaning articles heretofore processed with volatile solvents; promotes environmental safety by providing a commercially viable alternative to the use of volatile solvent cleaning techniques; provides a simplified apparatus and process for the ultrasonic cleaning and drying of articles to render the technique available for more widespread use; accomplishes effective ultrasonic cleaning at commercial production rates without the use of hazardous materials or the presence of hazardous conditions at the workplace; enables ease of operation for effective ultrasonic cleaning and drying in a wide variety of applications.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A compact ultrasonic cleaning and drying machine in which articles to be cleaned are presented to a cleaning station where the articles are ultrasonically cleaned and rinsed, the ultrasonic cleaning and drying machine comprising:

ultrasonic cleaning and rinsing means at the cleaning station for subjecting the articles to ultrasonic cleaning and rinsing over a first time interval;

drying means at a drying station closely juxtaposed with the cleaning station for subjecting the articles to drying over a second time interval subsequent to the first time interval;

a loading station and an unloading station; and indexing means for advancing a plurality of the articles serially along a path of travel extending between the loading station and the unloading station, from one location to another location of a plurality of locations placed along the path of travel, the plurality of locations including a first location at the cleaning station and a number of further locations within the drying station;

the second time interval being a multiple of the first time interval, and the number of further locations within the drying station being equal to said multiple such that each article is cleaned and rinsed at the first location, and then is subjected to drying at each further location along the path of travel between the loading station and the unloading station, the path of travel being a compact loop, whereby the ultrasonic cleaning and drying machine is rendered relatively compact and cleaned and dried articles are delivered at the unloading station upon the expiration of each first time interval.

2. The invention of claim 1 wherein the unloading station is coincident with the loading station, and the path of travel is a compact closed loop.

3. The invention of claim 1 wherein:

the ultrasonic cleaning and rinsing means includes a single tank having an access opening;

the drying means includes a housing and a chamber within the housing communicating with the access opening of the tank;

the path of travel extends through the access opening into and out of the tank, and through the chamber; and the indexing means includes a plurality of article carriers movable along the path of travel into and out of the tank and through the chamber.

4. The invention of claim 3 wherein the path of travel lies generally in a vertical plane.

5. The invention of claim 4 wherein:

the tank includes a bottom and an altitudinally opposite top, the access opening being located adjacent the top of the tank; and the indexing means includes a plurality of arms, a hub mounted for rotation about an axis of rotation extending generally horizontally above the top of the tank, the arms each extending radially from a near end at the hub to a far end, the article carriers each being coupled with the far end of a corresponding arm.

6. The invention of claim 5 wherein said multiple is three and the number of arms is four.

7. The invention of claim 5 including agitating means having an agitating drive means adjacent the tank and an agitating coupling means adjacent the far end of each arm such that each article carrier is coupled with the agitating drive means upon placement of that article carrier at said first location.

8. A method for ultrasonically cleaning and drying articles, the method comprising:

loading the articles at a loading station;

subjecting the articles to ultrasonic cleaning and rinsing at a cleaning station over a first time interval;

subjecting the articles to drying at a drying station closely juxtaposed with the cleaning station over a second time interval subsequent to the first time interval; and advancing the articles serially along a path of travel extending from one location to another location of a plurality of locations placed along a path of travel extending from the loading station to an unloading station, the plurality of locations including a first location at the cleaning station and a number of further locations within the drying station;

the second time interval being a multiple of the first time interval, and the number of further locations within the drying station being equal to said multiple such that each article is cleaned and rinsed at the first location, and then is subjected to drying at each further location along the path of travel between the loading station and the unloading station, the path of travel being a compact loop, whereby the method is accomplished in a relatively compact space and cleaned and dried articles are delivered at the unloading station upon the expiration of each first time interval.

9. The invention of claim 8 wherein the unloading station is coincident with the loading station, and the path of travel is a compact closed loop.

10. The invention of claim 8 wherein said multiple is three.

11. The invention of claim 8 including agitating the articles placed at the first location, during ultrasonic cleaning and rinsing.

* * * * *